US009002257B2

(12) United States Patent
Saiga

(10) Patent No.: US 9,002,257 B2
(45) Date of Patent: Apr. 7, 2015

(54) IMAGE FORMING APPARATUS

(75) Inventor: Soichi Saiga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 301 days.

(21) Appl. No.: 13/557,563

(22) Filed: Jul. 25, 2012

(65) Prior Publication Data

US 2013/0034376 A1 Feb. 7, 2013

(30) Foreign Application Priority Data

Aug. 1, 2011 (JP) ..... 2011-168443
Aug. 22, 2011 (JP) ..... 2011-180771
May 1, 2012 (JP) ..... 2012-104851

(51) Int. Cl.
*B65H 31/22* (2006.01)
*B41J 15/04* (2006.01)
*B41J 11/70* (2006.01)
*B41J 13/10* (2006.01)

(52) U.S. Cl.
CPC ..... *B41J 11/70* (2013.01); *B41J 13/106* (2013.01); *B41J 15/046* (2013.01)

(58) Field of Classification Search
CPC ..... B65H 31/00; B65H 31/22; B41J 15/00; B41J 15/04
USPC ..... 399/405; 400/611
See application file for complete search history.

(56) References Cited

U.S. PATENT DOCUMENTS 4,172,565 A * 10/1979 Zaffarano ..... 242/413.3
5,012,295 A * 4/1991 Ikkatai et al. ..... 399/384
5,157,450 A 10/1992 Kim
5,938,354 A * 8/1999 Yasui et al. ..... 400/621
5,963,216 A * 10/1999 Chiarabini et al. ..... 345/660
6,568,865 B1 * 5/2003 Fujioka et al. ..... 400/647.1
2001/0046405 A1 * 11/2001 Miyazaki ..... 400/605
2002/0054183 A1 * 5/2002 Kanaya ..... 347/23
2003/0042353 A1 * 3/2003 Savini et al. ..... 242/564.2
2003/0146565 A1 8/2003 Fujioka
2006/0044584 A1 * 3/2006 Sobczak ..... 358/1.13
2009/0196673 A1 * 8/2009 Akatsu et al. ..... 400/621

(Continued)

FOREIGN PATENT DOCUMENTS

CN 1433892 8/2003
CN 2895056 5/2007

(Continued)

OTHER PUBLICATIONS

Chinese official action dated Jun. 4, 2014 in corresponding Chinese patent application No. 2012 10 27 0353.4

*Primary Examiner* — Nguyen Ha
(74) *Attorney, Agent, or Firm* — Copper & Dunham LLP

(57) ABSTRACT

An image forming apparatus including a sheet roll supporter disposed below a main body of the image forming apparatus to support a sheet roll such that a sheet is fed from the sheet roll, an image forming unit to form an image on the sheet fed from the sheet roll, a sheet discharger disposed downstream from the image forming unit in a direction of conveyance of the sheet to discharge the sheet having the image thereon in a sheet discharging direction, a guide unit to guide the sheet discharged from the sheet discharger to the front of the main body of the image forming apparatus, and a stacking unit on which the sheet passing the guide unit is stacked. Upper and front parts of the sheet roll are covered with the guide unit and the stacking unit across a width direction of the sheet perpendicular to the sheet discharging direction.

12 Claims, 16 Drawing Sheets

(56) References Cited

U.S. PATENT DOCUMENTS

| | | | | |
|---|---|---|---|---|
| 2010/0025917 | A1* | 2/2010 | Yamaguchi | 271/10.13 |
| 2010/0231643 | A1 | 9/2010 | Saiga et al. | |
| 2010/0295897 | A1 | 11/2010 | Naruse et al. | |
| 2011/0064497 | A1* | 3/2011 | Niihara et al. | 399/363 |
| 2011/0114691 | A1* | 5/2011 | Morinaga | 226/102 |
| 2011/0134187 | A1 | 6/2011 | Naruse et al. | |
| 2011/0134190 | A1 | 6/2011 | Mase et al. | |
| 2011/0141192 | A1 | 6/2011 | Komuro et al. | |
| 2011/0199410 | A1 | 8/2011 | Mase et al. | |
| 2011/0205299 | A1 | 8/2011 | Naruse et al. | |
| 2011/0216113 | A1 | 9/2011 | Yorimoto et al. | |
| 2012/0026540 | A1* | 2/2012 | Nakamura | 358/1.15 |
| 2012/0056936 | A1 | 3/2012 | Shimizu et al. | |
| 2012/0062649 | A1 | 3/2012 | Naruse et al. | |

FOREIGN PATENT DOCUMENTS

| | | | | | |
|---|---|---|---|---|---|
| JP | S62-68960 | | | 4/1987 | |
| JP | 10-120275 | | | 5/1998 | |
| JP | 11-139632 | | | 5/1999 | |
| JP | 11277829 | A | * | 10/1999 | B41J 15/04 |
| JP | 2000-53305 | | | 2/2000 | |
| JP | 2003095511 | A | * | 4/2003 | B41J 31/02 |
| JP | 2006-206224 | | | 8/2006 | |
| JP | 2006-232491 | | | 9/2006 | |
| JP | 2006315876 | A | * | 11/2006 | B65H 31/00 |
| JP | 2010-070287 | | | 4/2010 | |
| JP | 2010132376 | A | * | 6/2010 | B65H 29/60 |

* cited by examiner $A < Lx$
$A + B > 4Lx / 5$

FIG. 15
EVALUATION OF STACKING PERFORMANCE
| TOTAL LENGTH OF FIRST AND SECOND SLOPED PORTIONS | STACKING PERFORMANCE |
|---|---|
| 3Lx/5 | SLIPPED OFF |
| 4Lx/5 | STACKED |
| Lx | STACKED |
FIG. 16A
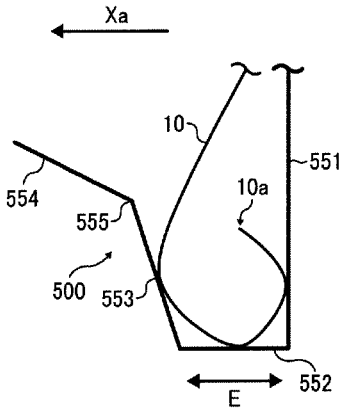
FIG. 16B
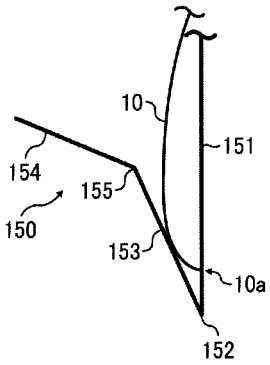

IMAGE FORMING APPARATUS

CROSS-REFERENCE TO RELATED APPLICATION

The present patent application is based on and claims priority pursuant to 35 U.S.C. §119 from Japanese Patent Applications No. 2011-168443, filed on Aug. 1, 2011, No. 2011-180771, filed on Aug. 22, 2011, and No. 2012-104851, filed on May 1, 2012, all in the Japan Patent Office, each of which is incorporated by reference herein in its entirety.

BACKGROUND OF THE INVENTION

1. Field of the Invention

Illustrative embodiments described in this patent specification generally relate to an image forming apparatus employing an inkjet method or an electrophotographic method, such as a copier, a printer, a plotter, a facsimile machine, and a multifunction device having two or more of copying, printing, plotting, and facsimile capabilities, and more particularly to an image forming apparatus including a stacking unit on which a sheet fed from a sheet roll set to the image forming apparatus is stacked after the sheet having an image thereon is discharged from the image forming apparatus.

2. Description of the Related Art

There are known image forming apparatuses that form an image on a sheet fed from a continuous sheet roll supported by a sheet roll supporter disposed to a front side of the image forming apparatus. The sheet having the image thereon is then discharged to the front side of the image forming apparatus. Such image forming apparatuses are often provided with a dedicated discharge guide member disposed above the sheet roll supporter, such that the sheet having the image thereon discharged from the image forming apparatus is prevented from contacting the sheet roll on which no image has yet been formed. However, because the sheet roll is substantially exposed to the outside of the image forming apparatus, dust may adhere to the sheet roll, thereby degrading both sheet feeding and image quality. To solve the above problem, the sheet roll is completely covered with a withdrawable sheet feed tray provided to the front side of the image forming apparatus so as to prevent adherence of dust to the sheet roll.

In addition, a detachable stacking unit on which the sheet discharged from the image forming apparatus is stacked is often attached to the front side of the image forming apparatus to facilitate access to the sheet discharged from the image forming apparatus.

However, although the sheet roll is securely protected from dust in the above-described example, a configuration of the sheet feed tray is complicated, thereby increasing production costs. Further, because a part of the sheet roll set to the sheet feed tray is positioned in front of a sheet discharger from which the sheet having the image thereon is discharged, a depth of the image forming apparatus is increased when a member such as the sheet feed tray that covers the sheet roll is provided, thereby increasing the overall size of the image forming apparatus.

BRIEF SUMMARY OF THE INVENTION

In view of the foregoing, illustrative embodiments described herein provide a novel image forming apparatus that reliably discharges a sheet having an image thereon to a stacking unit while preventing the sheet from contacting a sheet roll supported by a sheet roll supporter with an uncomplicated and inexpensive configuration. In addition, the image forming apparatus also prevents adherence of dust and so forth to the sheet roll set to the image forming apparatus.

In one illustrative embodiment, an image forming apparatus includes a sheet roll supporter disposed below a main body of the image forming apparatus to support a sheet roll formed of a single continuous sheet such that the sheet is fed from the sheet roll, an image forming unit to form an image on the sheet fed from the sheet roll supported by the sheet roll supporter, a sheet discharger disposed downstream from the image forming unit in a direction of conveyance of the sheet to discharge the sheet having the image thereon in a sheet discharging direction, a guide unit to guide the sheet discharged from the sheet discharger to the front of the main body of the image forming apparatus, and a stacking unit on which the sheet passing the guide unit is stacked. Upper and front parts of the sheet roll are covered with the guide unit and the stacking unit across a width direction of the sheet perpendicular to the sheet discharging direction.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 15 is a table showing a relation between a total length of the first and second sloped portions of the stacking unit and evaluation results of stacking performance of the stacking unit;

FIG. 16A is a schematic view illustrating a state of a leading edge of a sheet guided by a restriction member of a stacking unit according to a comparative example;

FIG. 16B is a schematic view illustrating a state of a leading edge of a sheet guided by a restriction member of the stacking unit according to the second illustrative embodiment;

DETAILED DESCRIPTION OF ILLUSTRATIVE EMBODIMENTS

Figure 1:
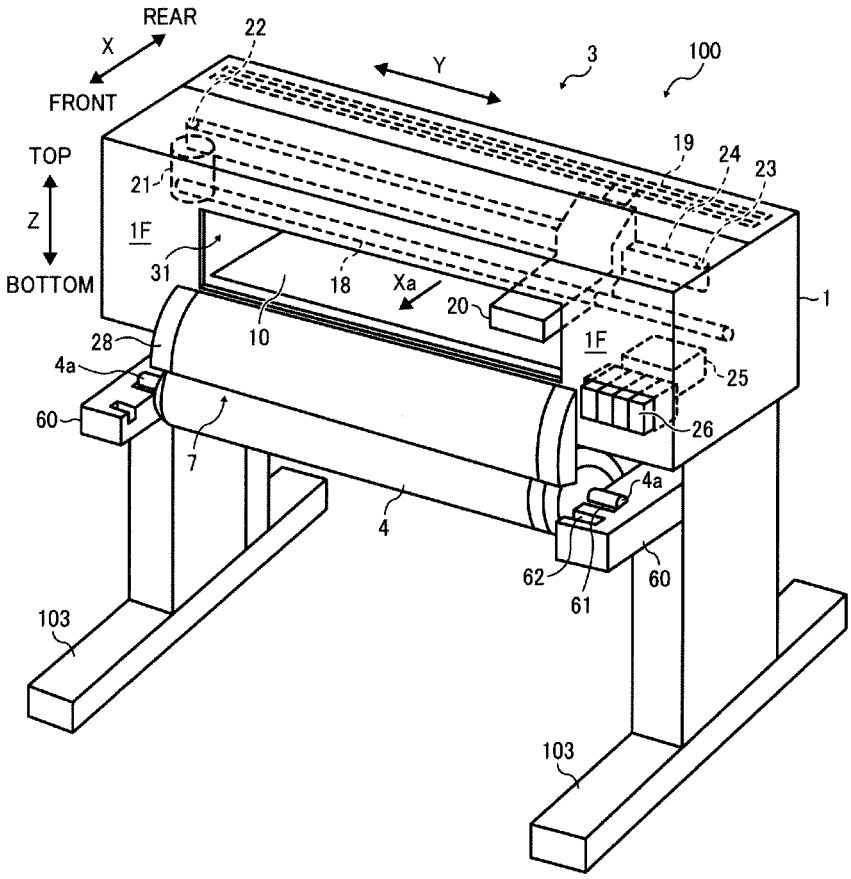
FIG. 1 is a perspective view illustrating an example of a configuration of an image forming apparatus according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Figure 2:
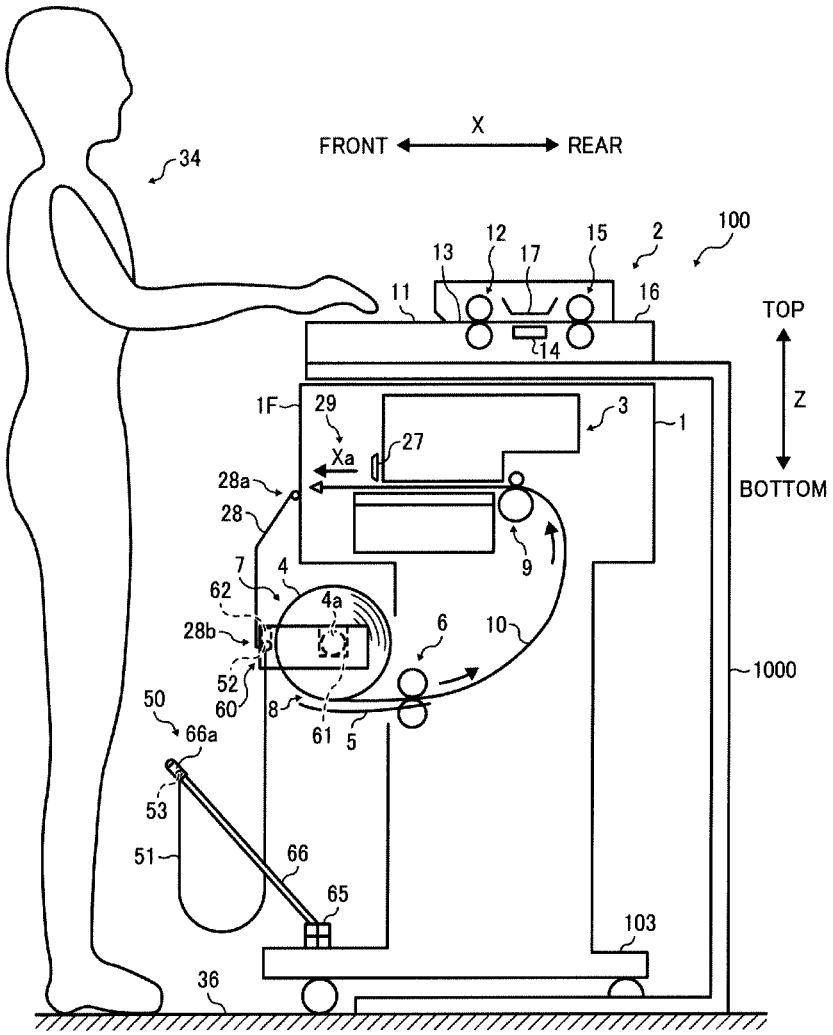
FIG. 2 is a vertical cross-sectional view illustrating the configuration of the image forming apparatus illustrated in FIG. 1.
Figure 3:
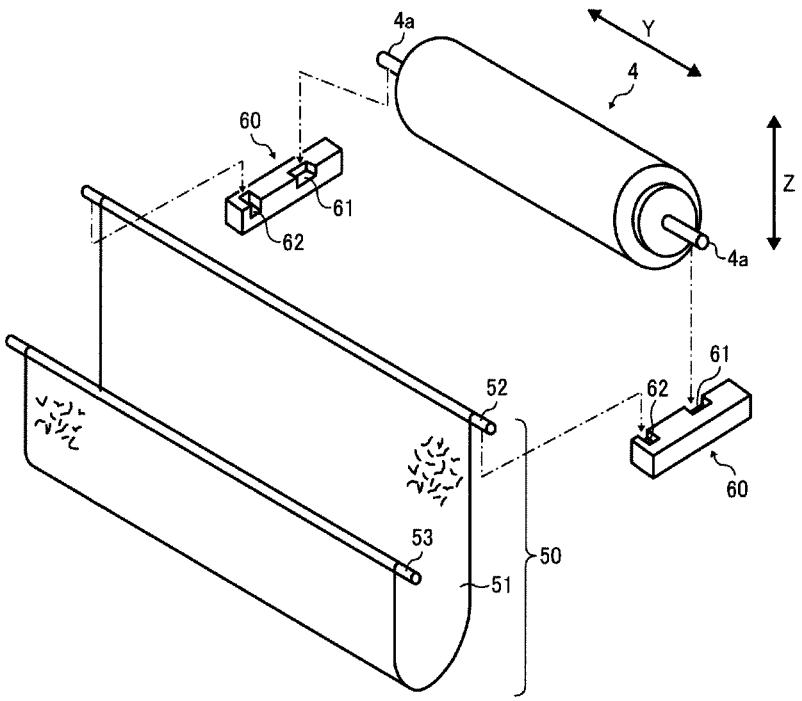
FIG. 3 is an exploded perspective view illustrating setting of a sheet roll and a discharge bucket to a sheet feeder according to the first illustrative embodiment.

A configuration and operation of an image forming apparatus 100 according to a first illustrative embodiment are described in detail below, with reference to FIGS. 1 to 3. FIG. 1 is a perspective view illustrating an example of a configuration of the image forming apparatus 100 according to the first illustrative embodiment. FIG. 2 is a vertical cross-sectional view illustrating the configuration of the image forming apparatus 100 illustrated in FIG. 1. FIG. 3 is an exploded perspective view illustrating setting of a sheet roll 4 and a discharge bucket 50 to a sheet feeder 60. It is to be noted that some components of the image forming apparatus 100 illustrated in FIG. 2, such as an image reading unit 2, the discharge bucket 50, side rod brackets 65, and a stand 1000, are not shown in FIG. 1 for ease of illustration. In addition, although a discharge guide plate 28 is extended downward to the front of the sheet feeder 60 as illustrated in FIG. 2, a lower portion of the discharge guide plate 28 is omitted in FIG. 1 for ease of illustration.

The image forming apparatus 100 includes the image reading unit 2, an image forming unit 3, and the sheet feeder 60, in that order, from the top to the bottom thereof.

In FIG. 2, a horizontal direction perpendicular to top and bottom directions Z (hereinafter also referred to as a vertical direction Z) is front and rear directions X of the image forming apparatus 100. Specifically, a front side 1F of the image forming apparatus 100 is shown on the left in FIG. 2, and the rear of the image forming apparatus 100 is shown on the right in FIG. 2. A direction perpendicular to the vertical direction Z and the front and rear directions X, that is, a direction passing through the plane of FIG. 2, is a main scanning direction Y shown in FIG. 1 which corresponds to a width direction of the sheet roll 4 (hereinafter also referred to as a width direction Y).

The image reading unit 2 reads an image of a document placed thereon, and the image forming unit 3 forms an image on a sheet 10 fed from the sheet roll 4. The sheet feeder 60 is disposed to both ends on the front side 1F of a main body 1 of the image forming apparatus 100 in the main scanning direction Y, and has sheet roll supporters 61 that detachably support the sheet roll 4 such that the sheet 10 is fed from the sheet roll 4 composed of a paper core and a single long sheet wound around the paper core. Although the image reading unit 2 is placed on the stand 1000 provided separately from the main body 1 of the image forming apparatus 100 in the present embodiment, alternatively, the image reading unit 2 and the main body 1 may be formed together as a single integrated unit.

The image reading unit 2 includes a document stand 11 on which a document is set, a pair of document feed rollers 12 serving as a document conveyance unit to convey the document to an image reading position from the front to the rear of the image forming apparatus 100, a contact image sensor 14 serving as an image reader provided at the image reading position to read an image of the document, a pair of document discharge rollers 15 serving as a document discharger to discharge the document after the image of the document is read, and a document discharge stand 16 to stack the document discharged by the pair of document discharge rollers 15.

The document set on the document stand 11 is conveyed sheet by sheet (if the document consists of multiple sheets) by the pair of document feed rollers 12 to a document conveyance path 13. An image of the document thus conveyed is read by the contact image sensor 14 provided at the image reading position within the document conveyance path 13. After the image is read by the contact image sensor 14, the document is discharged to the document discharge stand 16 by the pair of document discharge rollers 15. The contact image sensor 14 extends over a substantial part of the width of the image forming apparatus 100, that is, in the main scanning direction Y, and includes a light source to direct light onto the document and an image sensor. Specifically, the light source of the contact image sensor 14 directs light onto the document conveyed through the document conveyance path 13 to focus the light reflected from the document on the image sensor through a lens array or the like. Thereafter, the light thus focused is photoelectrically converted into an image signal. The image reading unit 2 further includes a pressing plate 17 positioned opposite a contact glass, not shown, provided above the contact image sensor 14. The pressing plate 17 presses the document toward the contact glass, and serves also as a white reference plate.

The image forming unit 3 employs an inkjet recording system to form images. As illustrated in FIG. 1, the image forming apparatus 100 is a serial-type inkjet recording device.

The image forming unit 3 includes a guide rod 18 and a guide rail 19 each extended across right and left lateral plates of the image forming apparatus 100, not shown. The guide rode 18 and the guide rail 19 slidably hold a carriage 20 movable in the main scanning direction Y. The carriage 20 includes liquid ejection heads (or recording heads), not shown, each ejecting ink droplets of a specific color, that is, black (K), yellow (Y), magenta (M), or cyan (C). Each of the recording heads includes a sub-tank, not shown, integrally formed therewith to supply ink of the specified color to the recording heads.

A main scanning mechanism that scans the carriage 20 in the main scanning direction Y includes: a drive motor 21 provided at one end of the image forming unit 3 in the main scanning direction Y, that is, the upper left in FIG. 1; a drive pulley 22 connected to an output shaft of the drive motor 21 to be rotatively driven by the drive motor 21; a driven pulley 23 provided at the other end of the image forming unit 3 in the main scanning direction Y, that is, the lower right in FIG. 1; and a belt member 24 wound around the drive pulley 22 and the driven pulley 23. A tension spring, not shown, applies tension to the driven pulley 23 outward, that is, in a direction away from the drive pulley 22. A part of the belt member 24 is fixed to a belt fixing part, not shown, provided on a back surface of the carriage 20 to pull the carriage 20 in the main scanning direction Y.

An encoder sheet, not shown, is provided along the main scanning direction Y of the carriage 20 to detect a main scanning position of the carriage 20. The encoder sheet is read by an encoder sensor, not shown, provided on the carriage 20. In an image recording range within a main scanning range of the carriage 20, the sheet 10 fed from the sheet roll 4 is intermittently conveyed in a sub-scanning direction Xa perpendicular to the main scanning direction Y of the carriage 20, by a sheet conveyance mechanism, not shown. The sub-scanning direction Xa corresponds to a direction of discharge of the sheet 10 from the image forming apparatus 100 (hereinafter also referred to as a sheet discharging direction Xa). The image forming unit 3 further includes a maintenance mechanism 25 that performs maintenance on the recording heads of the carriage 20 at one end of the main scanning range of the carriage 20, that is, the lower right in FIG. 1. Ink cartridges 26 each storing ink of the specified color to supply the ink to the sub-tank of each of the recording heads are detachably attached to the main body 1 of the image forming apparatus 100.

The sheet 10 having the image formed by the image forming unit 3 is cut by a cutter 27 to a predetermined length. It is to be noted that a well-known cutter may be used as the cutter 27. Specifically, the cutter 27 is fixed to a wire or a timing belt wound around multiple pulleys. The wire or the timing belt is moved in the main scanning direction Y by the drive motor 21 via one of the multiple pulleys connected to the drive motor 21 so that the sheet 10 is cut to the predetermined length by the cutter 27.

In FIG. 2, reference numeral 29 denotes a sheet discharger that discharges the sheet 10 having the image thereon. The sheet discharger 29 includes a discharge opening 31 provided downstream from the cutter 27 in the sheet discharging direction Xa, a guide unit, which, in the present illustrative embodiment, is the discharge guide plate 28, a stacking unit, which, in the present illustrative embodiment, is the discharge bucket 50, and so forth. The discharge opening 31 from which the sheet 10 having the image thereon is discharged from the main body 1 of the image forming apparatus 100 is formed in the front side 1F of the image forming apparatus 100.

The discharge guide plate 28 that guides the sheet 10 discharged from the discharge opening 31 to the discharge bucket 50 is provided downstream from the discharge opening 31 in the sheet discharging direction Xa outside the front side 1F of the image forming apparatus 100. The discharge guide plate 28 has a curved guide surface, a bottom portion of which protrudes beyond the front side 1F of the image forming apparatus 100 farther than an upper portion thereof does. An upper part of an opening 7 formed in the main body 1 to accommodate the sheet roll 4 is covered with the discharge guide plate 28. The discharge guide plate 28 has a top base end 28*a* and a free bottom end 28*b*. A support shaft (a hinge) is provided to a portion in which the base end 28*a* is connected to the front side 1F of the image forming apparatus 100 so that the bottom end 28*b* is swingably openable around the base end 28*a* in the vertical direction Z. Accordingly, an operator or a user of the image forming apparatus 100 (hereinafter referred to as a user 34) can easily attach and detach the sheet roll 4 to and from the sheet roll supporters 61 of the sheet feeder 60 while opening the discharge guide plate 28.

As described above, the sheet feeder 60 has the sheet roll supporters 61. The sheet roll supporters 61 detachably support a spool shaft 4*a*, which, in the present illustrative embodiment, is a core of the sheet roll 4 that passes through the sheet roll 4 in a longitudinal direction. Although the spool shaft 4*a* is rotatably supported by the concave sheet roll supporters 61 in the example shown in FIGS. 1 to 3, alternatively, bearings may be used to support the spool shaft 4*a*.

Upper and front portions of the sheet feeder 60 throughout the width direction Y are covered with the discharge guide plate 28 and the discharge bucket 50. A supported member, which, in the present illustrative embodiment, is a discharge rod 52, provided to an upper end of the discharge bucket 50 is supported such that the discharge rod 52 partially overlaps the bottom end 28*b* of the discharge guide plate 28 when viewed from the horizontal direction, inboard of the bottom end 28*b* of the discharge guide plate 28. Accordingly, upper and front portions of the sheet roll 4 accommodated within the image forming apparatus 100 are covered with the discharge guide plate 28 and the discharge bucket 50 throughout the width direction Y perpendicular to the sheet discharging direction Xa. The above-described uncomplicated and inexpensive configuration allows secure discharge of the sheet 10 to the discharge bucket 50 and prevents the sheet 10 from entering the sheet feeder 60 and contacting the sheet roll 4, thereby preventing the sheet roll 4 from getting soiled. In addition, adherence of dust to the sheet roll 4 can be prevented in advance.

It is to be noted that, although the front side 1F of the image forming apparatus 100 from the discharge opening 31 to a lower portion of the image forming apparatus 100 is covered with the discharge guide plate 28 and the discharge bucket 50 as illustrated in FIG. 2, the configuration is not limited thereto as long as the front side 1F of the image forming apparatus 100 at the position of the sheet roll 4 supported by the sheet roll supporters 61 is covered.

In addition, it is preferable that the discharge rod 52 be supported at substantially the same position as the sheet roll supporters 61 as illustrated in FIG. 2, which also includes a case in which the discharge rod 52 is supported at substantially the same height as the sheet roll supporters 61 as well as a case in which it is supported offset from the spool shaft 4*a* supported by the sheet roll supporters 61 to partially overlap the spool shaft 4*a* in the horizontal direction. The position of the discharge rod 52 is described in detail later with reference to FIGS. 4 and 5.

Further, in addition to the sheet roll supporters 61, it is preferable that rod supporters 62 that support the discharge rod 52 at substantially the same height as the sheet roll supporters 61 also be formed together with the sheet feeder 60 as a single integrated unit. As a result, it is not necessary to separately provide the rod supporters 62, thereby achieving the uncomplicated configuration at reduced cost.

At this time, it is preferable that the rod supporters 62 detachably support the discharge rod 52. Although each of the rod supporters 62 has a concave shape in the above-described example, the configuration of the rod supporters 62 is not limited thereto as long as the discharge rod 52 are detachably attachable to the rod supporters 62.

Legs 103 are provided below the sheet feeder 60, and the side rod brackets 65 are fixed to the legs 103, respectively. Both ends of a front rod 53 of the discharge bucket 50 are mounted to side rods 66, respectively, and a base of each of the side rods 66 are mounted to the side rod brackets 65 such that an angle of the side rods 66 is adjustable. Rod supporters 66*a* into which the both ends of the front rod 53 are inserted, respectively, are provided to a leading end of each of the side rods 66 to support the front rod 53, and the base of each of the side rods 66 is mounted to the side rod brackets 65 such that the angle of the side rods 66 is adjustable. A position of the front rod 53 in the vertical direction Z is changed by adjusting the angle of the base of each of the side rods 66, thereby adjusting capacity of the discharge bucket 50 to stack the sheet 10 therein.

The discharge bucket 50 is a discharge tray on which the sheet 10 discharged from the image forming apparatus 100 is stacked. The discharge bucket 50 includes a main body 51 formed of a flexible material such as cloth or a member including cloth. One end of the main body 51 is fixed to the discharge rod 52 and the other end thereof is fixed to the front rod 53. The discharge rod 52 is supported by the rod supporters 62 and the front rod 53 is supported by the rod supporters 66*a* of the side rods 66 disposed below the rod supporters 62 so that the main body 51 of the discharge bucket 50 formed between the discharge rod 52 and the front rod 53 is substantially U-shaped, having a forward-facing opening.

Alternatively, the main body 51 of the discharge bucket 50 may be formed of a flexible mesh member so that edges or corners of the sheet 10 discharged to the discharge bucket 50 are not caught by the main body 51.

The main body 51 of the discharge bucket 50, the one end of which is fixed to the discharge rod 52, hangs by its own weight from a position which overlaps the bottom end 28*b* of the discharge guide plate 28, such that the front side 1F of the image forming apparatus 100 from the sheet roll supporters 61 to the lower part of the image forming apparatus 100 is covered with the main body 51 of the discharge bucket 50 throughout the width direction Y.

The discharge bucket 50 is disposed such that both the remaining part of the opening 7 which is not covered with the discharge guide plate 28 and an opening 8 provided below the sheet feeder 60 to accommodate a lower part of the sheet roll 4 are covered with the discharge bucket 50. In addition, as described previously, the discharge bucket 50 is disposed such that the discharge rod 52 is continuous with the bottom end 28*b* of the discharge guide plate 28 in the vertical direction Z.

Each of the discharge rod 52 and the front rod 53 is a bar member formed of resin or the like, extending in the main scanning direction Y. The discharge bucket 50 is detachably attachable to the main body 1 of the image forming apparatus 100 via the rod supporters 62 formed in the sheet feeder 60. The front rod 53 is positioned to facilitate operation and maintenance on the image forming apparatus 100 from the front side 1F of the image forming apparatus 100.

It is to be noted that in FIGS. 1 and 2, reference numeral 5 denotes a guide plate that guides the sheet 10 fed from the sheet roll 4, reference numeral 6 denotes a pair of conveyance rollers that conveys the sheet 10 fed from the sheet roll 4, reference numeral 7 denotes the opening from which the sheet roll 4 is set or detached to and from a sheet roll storage within the main body 1 of the image forming apparatus 100, reference numeral 9 denotes a pair of registration rollers, and reference numeral 36 denotes a floor on which casters provided to the bottom of the image forming apparatus 100 via the legs 103 and the base of the stand 1000 are placed.

A description is now given of operation of the image forming apparatus 100, again with reference to FIGS. 1 and 2.

The sheet 10 fed from the sheet roll 4 is conveyed by the pair of conveyance rollers 6. Conveyance of the sheet 10 is temporarily stopped when a leading edge of the sheet 10 contacts the pair of registration rollers 9. After any skew of the sheet 10 is corrected, the pair of registration rollers 9 is rotated so that the sheet 10 is conveyed to the image forming unit 3 at a predetermined timing. The image forming unit 3 forms an image on the sheet 10, and then the sheet 10 having the image thereon is discharged outside the main body 1 from the discharge opening 31 formed in the front side 1F of the image forming apparatus 100. The sheet 10 thus discharged is guided by the discharge guide plate 28 and is stacked within the discharge bucket 50 disposed continuously below the discharge guide plate 28.

It is to be noted that the image reading unit 2 need not be provided to the image forming apparatus 100. Because the image reading unit 2 is disposed above the image forming unit 3 in the present illustrative embodiment, the height of the image forming apparatus 100 is limited in order to facilitate setting of the document on the image reading unit 2.

In an image forming apparatus with reduced height, it is difficult to dispose a stacking unit, to which a sheet discharged from the image forming apparatus is stacked, below the image forming unit. Therefore, in the present illustrative embodiment, the stacking unit, that is, the discharge bucket 50, is provided to the front side 1F of the main body 1 as illustrated in FIG. 2. As a result, the user 34 can easily access the sheet 10 discharged from the image forming apparatus 100 and handle even the large-sized sheet 10.

The discharge bucket 50 is easily attached to and detached from the main body 1 of the image forming apparatus 100 upon replacement of the discharge bucket 50 or the sheet roll 4 with another type of the stacking unit or the sheet roll.

Figure 4A:
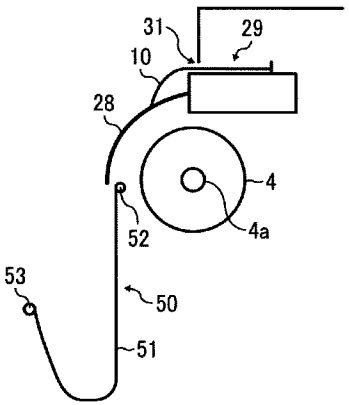
FIG. 4A is a schematic view illustrating an initial state of a sheet discharged from the image forming apparatus according to the first illustrative embodiment.
Figure 4B:
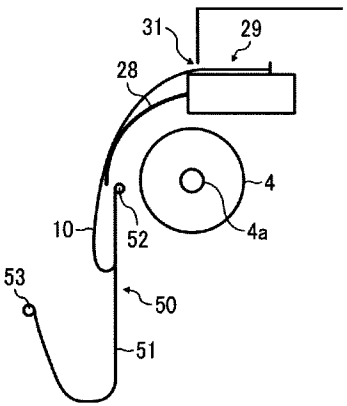
FIG. 4B is a schematic view illustrating discharge of the sheet after the state illustrated in FIG. 4A according to the first illustrative embodiment.
Figure 4C:
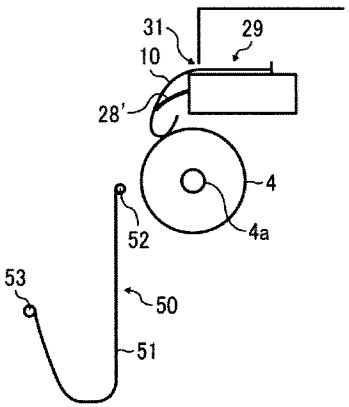
FIG. 4C is a schematic view illustrating discharge of the sheet according to a first comparative example.
Figure 5A:
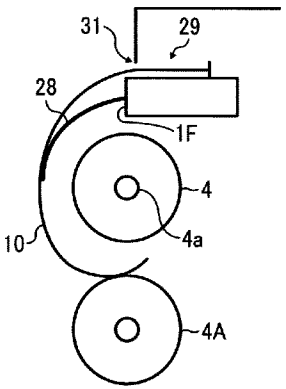
FIG. 5A is a schematic view illustrating discharge of the sheet according to a second comparative example.
Figure 5B:
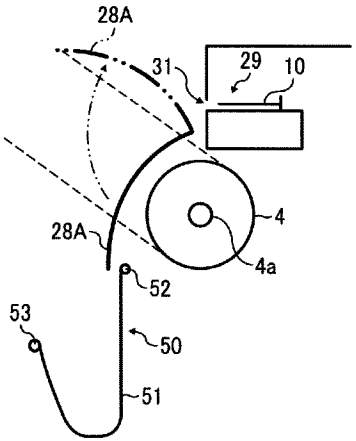
FIG. 5B is a schematic view illustrating a configuration of a sheet discharger according to a third comparative example.
Figure 5C:
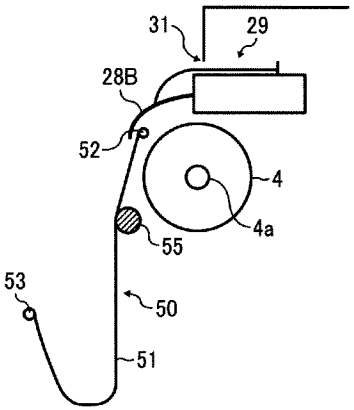
FIG. 5C is a schematic view illustrating a configuration of a sheet discharger according to a fourth comparative example.

A description is now given of discharge of the sheet 10 to the discharge bucket 50. FIG. 4A is a schematic view illustrating an initial state of the sheet 10 discharged from the image forming apparatus 100 according to the first illustrative embodiment. FIG. 4B is a schematic view illustrating discharge of the sheet 10 after the state illustrated in FIG. 4A according to the first illustrative embodiment. FIG. 4C is a schematic view illustrating discharge of the sheet 10 according to a first comparative example. FIG. 5A is a schematic view illustrating discharge of the sheet 10 according to a second comparative example. FIG. 5B is a schematic view illustrating a configuration of the sheet discharger 29 according to a third comparative example. FIG. 5C is a schematic view illustrating a configuration of the sheet discharger 29 according to a fourth comparative example. It is to be noted that the sheet feeder 60 is omitted in FIGS. 4 and 5 for ease of illustration.

In the first illustrative embodiment, the discharge rod 52 of the discharge bucket 50 is set to the rod supporters 62 such that the discharge bucket 50 is continuous with the discharge guide plate 28 as illustrated in FIGS. 2, 4A, and 4B. Specifically, the bottom end 28*b* of the discharge guide plate 28 is continuous with the discharge rod 52 provided to the upper portion of the discharge bucket 50 so that the leading edge of the sheet 10 discharged from the discharge opening 31 of the image forming apparatus 100 is smoothly guided from the discharge guide plate 28 to the discharge bucket 50 as illustrated in FIGS. 4A and 4B. Accordingly, the sheet 10 is reliably stacked in the discharge bucket 50.

By contrast, in the first comparative example illustrated in FIG. 4C, a discharge guide plate 28', which is shorter than the discharge guide plate 28 of the first illustrative embodiment, does not reach the sheet roll supporters 61, leaving a gap between the discharge guide plate 28' and the discharge bucket 50. Consequently, the leading edge of the sheet 10 may enter between the sheet roll 4 and the discharge bucket 50, and an image forming surface of the sheet 10 on which the image is formed may contact the sheet roll 4, thereby soiling the sheet roll 4.

In the second comparative example illustrated in FIG. 5A, two pairs of sheet roll supporters are provided to the front side 1F of the image forming apparatus 100 to support sheet rolls 4 and 4A one above the other, respectively, and a gap is formed between the discharge guide plate 28 and the discharge bucket 50, not shown. Consequently, the sheet 10 may enter the lower pair of sheet roll supporters that support the sheet roll 4A and contact the sheet roll 4A, thereby soiling the sheet roll 4A. Thus, the discharge bucket 50 needs to be continuous with the discharge guide plate 28 not only for protecting the sheet roll 4 from dust but also for preventing the sheet 10 from contacting the sheet roll 4.

In addition, it is preferable that the discharge rod 52 of the discharge bucket 50 be attached to the rod supporters 62 of the sheet feeder 60 at substantially the same height as the sheet roll supporters 61 because of the reasons described below.

In the third comparative example illustrated in FIG. 5B, the discharge rod 52 is attached to the rod supporters 62 of the sheet feeder 60 at a position below the sheet roll 4. In the fourth comparative example illustrated in FIG. 5C, the discharge rod 52 is attached to the rod supporters 62 of the sheet feeder 60 at a position above the sheet roll 4. In both cases, the discharge bucket 50 is continuous with a discharge guide plate 28A of the third comparative example or a discharge guide plate 28B of the fourth comparative example, thereby protecting the sheet roll 4 from dust and preventing the sheet 10 from contacting the sheet roll 4.

However, in the case of the third comparative example illustrated in FIG. 5B, the discharge guide plate 28A needs to be long enough to be continuous with the discharge bucket 50. Consequently, when being hingedly opened upward, the long discharge guide plate 28A hinders easy replacement of the sheet roll 4. In addition, the user 34 cannot stand closer to the sheet roll 4 upon opening of the long discharge guide plate 28A.

By contrast, the length of the discharge guide plate 28B is reduced in the fourth comparative example illustrated in FIG. 5C. As a result, although the short discharge guide plate 28B can be easily handled, the discharge bucket 50 needs to be disposed above the sheet roll supporters 61. In a case in which the main body 51 of the discharge bucket 50 is formed of cloth, provision of a guide member 55 that guides the main body 51 as illustrated in FIG. 5C is required, thereby increasing the number of components. Thus, considering the relative positions of the discharge guide plate 28 and the discharge bucket 50, it is preferable that the discharge rod 52 of the discharge bucket 50 be disposed at substantially the same height as the sheet roll supporters 61. In addition, considering reduction of the number of components, it is preferable that the discharge rod 52 of the discharge bucket 50 be attached to the sheet feeder 60 to which the sheet roll 4 is attached.

According to the first illustrative embodiment, the sheet 10 having the image thereon can be reliably discharged to the discharge bucket 50 without contacting the sheet roll 4 set to the sheet roll supporters 61 with the uncomplicated and inexpensive configuration. In addition, adherence of dust to the sheet roll 4 can be prevented.

The main body 51 of the discharge bucket 50 is formed of a flexible material such as cloth, and the one end of the main body 51 is fixed to the discharge rod 52 such that the main body 51 hangs by its own weight from the position overlapping the bottom end 28*b* of the discharge guide plate 28. As a result, the front side 1F of the image forming apparatus 100 from the sheet roll supporters 61 to the lower portion of the image forming apparatus 100 is covered with the main body 51 of the discharge bucket 50 throughout the width direction Y, thereby securing a discharge path of the sheet 10 from the sheet discharger 29 to the discharge bucket 50 with the reduced number of components.

Figure 6:
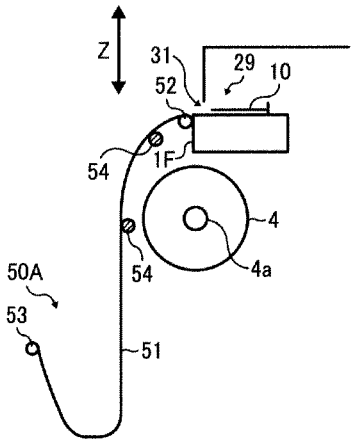
FIG. 6 is a schematic view illustrating a configuration of a discharge bucket according to a first variation of the first illustrative embodiment.

A description is now given of a first variation of the first illustrative embodiment with reference to FIG. 6. FIG. 6 is a schematic view illustrating a configuration of a discharge bucket 50A according to the first variation.

Differing from the first illustrative embodiment, the discharge guide plate 28 and the discharge bucket 50 of the first illustrative embodiment are formed together as the single integrated discharge bucket 50A in the first variation. The rest of the configuration according to the first variation is the same as that of the first illustrative embodiment.

The discharge rod 52 of the discharge bucket 50A is attached to the concave rod supporters 62 provided to the front side 1F of the image forming apparatus 100 so that the front side 1F of the image forming apparatus 100 from the sheet roll supporters 61 to the lower portion of the image forming apparatus 100 is covered with the discharge bucket 50A along multiple guide members 54 disposed in the vertical direction Z. As a result, the sheet roll 4 attached to the sheet roll supporters 61 can be protected and the discharge path can be secured without the discharge guide plate 28.

The guide members 54 are provided such that the discharge bucket 50A has the similar effect and posture to the discharge guide plate 28 of the first illustrative embodiment. The guide members 54 may be formed together with the main body 51 of the discharge bucket 50A or be detachably attachable to the main body 1 of the image forming apparatus 100. In a case in which the guide members 54 are formed together with the main body 51 of the discharge bucket 50A, support members that support both ends of each of the guide members 54 need to be provided to the main body 1 of the image forming apparatus 100. Thus, the upper and front portions of the sheet roll 4 may be covered with the single discharge bucket 50A supported by the multiple guide members 54.

Figure 7:
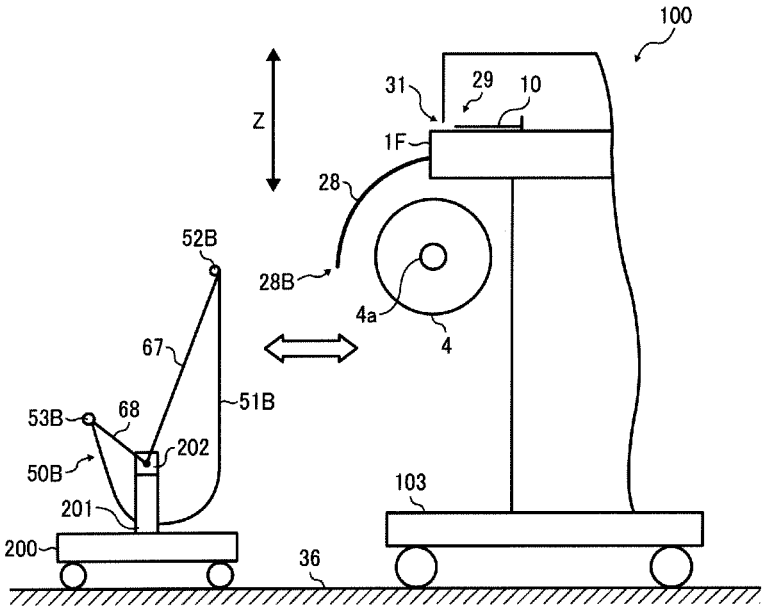
FIG. 7 is a schematic view illustrating a configuration of a discharge bucket according to a second variation of the first illustrative embodiment.

A description is now given of the second variation of the first illustrative embodiment with reference to FIG. 7. FIG. 7 is a schematic view illustrating a configuration of a discharge bucket 50B according to the second variation.

In place of the discharge bucket 50A of the first variation, the separate discharge bucket 50B detachably attachable to the main body 1 of the image forming apparatus 100 is used in the second variation. The rest of the configuration according to the second variation is the same as that of the first variation.

In the first variation illustrated in FIG. 6, the discharge rod 52 of the discharge bucket 50A is attached to the front side 1F of the image forming apparatus 100 such that the front side 1F of the image forming apparatus 100 from the sheet roll supporters 61 to the lower part of the image forming apparatus 100 is covered with the discharge bucket 50A. The discharge bucket 50B of the second variation is configured to solve inconvenience in the first variation in which an increase in the size of the discharge bucket 50A hinders easy replacement of the sheet roll 4.

It is to be noted that in FIG. 7, reference numeral 200 denotes a movable stand with casters, reference numeral 201 denotes a unit frame disposed on the movable stand 200, reference numeral 202 denotes a rod support bracket provided on the unit frame 201, and reference numerals 67 and 68 respectively denote rod supporters. The discharge bucket 50B includes a main body 51B formed of a cloth member, a first supported member, that is, a discharge rod 52B, and a second supported member, that is, a front rod 53B. Both ends of the discharge rod 52B in a direction perpendicular to the plane of FIG. 7 are supported by the rod supporters 67, respectively, and both ends of the front rod 53B in the direction perpendicular to the plane of FIG. 7 are supported by the rod supporters 68, respectively. A base of each of the rod supporters 67 and 68 is supported by the rod brackets 202 provided to both ends of the discharge bucket 50B in the direction perpendicular to the plane of FIG. 7 such that the angle of each of the rod supporters 67 and 68 is adjustable, thereby adjusting capacity of the discharge bucket 50B to stack the sheet 10 therein.

The discharge bucket 50B is moved together with the movable stand 200 to the right in FIG. 7 until the discharge rod 52B overlaps the bottom end 28*b* of the discharge guide plate 28 to attach the discharge bucket 50B to the image forming apparatus 100.

It is to be noted that the rod supporters 67 need not be provided to the discharge bucket 50B, in which case, after the discharge bucket 50B is moved together with the movable stand 200 to the right, the discharge rod 52B may be attached to the rod supporters 62 of the sheet feeder 60 provided to the front side 1F of the image forming apparatus 100 in a similar manner to the first illustrative embodiment.

In comparison with the first variation, the discharge bucket 50B of the second variation is provided separately from the main body 1 of the image forming apparatus 100 and is movable relative to the image forming apparatus 100, thereby achieving a user-friendly configuration. As a result, no component is provided to the front side 1F of the image forming apparatus 100, thereby facilitating replacement of the sheet roll 4.

Figure 8:
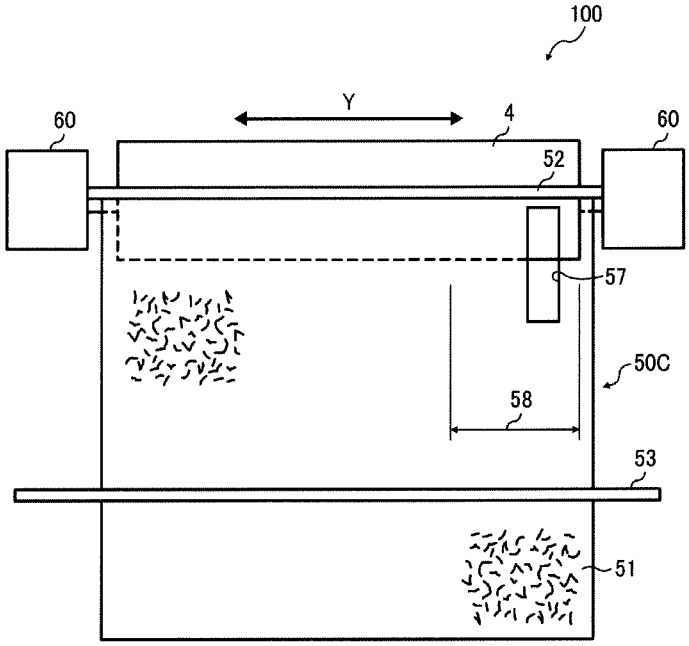
FIG. 8 is a front view illustrating a configuration of a discharge bucket according to a third variation of the first illustrative embodiment.

A description is now given of a third variation of the first illustrative embodiment with reference to FIG. 8. FIG. 8 is a front view illustrating a configuration of a discharge bucket 50C according to the third variation.

In the configuration in which the front side 1F of the image forming apparatus 100 is covered, it is difficult to visually confirm an amount of the sheet roll 4 accommodated within the image forming apparatus 100. The third variation allows easy confirmation of the amount of the sheet roll 4 accommodated within the image forming apparatus 100.

Differing from the first illustrative embodiment, the discharge bucket 50C is used in the third variation in place of the discharge bucket 50. The rest of the configuration according to the third variation is the same as that of the first illustrative embodiment.

The discharge bucket 50C has a transparent part, which in the present embodiment is a slit 57, through which the interior of the main body 1 of the image forming apparatus 100 is visible. The slit 57 is formed in front of the sheet roll supporters 61 within a minimum range 58 in the main body 51 of the discharge bucket 50C in the width direction Y through which the sheet 10 of the minimum size used in the image forming apparatus 100 passes. The configuration of the third variation can also be combined with the first and second variations.

In a case in which the slit 57 is formed at a position corresponding to the edge of the sheet 10 discharged to the discharge bucket 50C in the width direction Y, the edge of the sheet 10 may be caught in the slit 57, thereby wrinkling or tearing the sheet 10. Therefore, it is preferable that the slit 57 be formed in front of the sheet roll supporters 61 within the minimum range 58 through which the sheet 10 of the minimum size passes when being discharged so that the amount of the sheet roll 4 remaining can be visually confirmed from the front side 1F of the image forming apparatus 100. It is more preferable that a bottom end of the slit 57 be provided above a position where the sheet 10 guided by the discharge guide plate 28 first contacts the discharge bucket 50C, thereby preventing the leading edge of the sheet 10 from entering the slit 57.

The transparent part is not limited to the slit 57. Alternatively, a transparent material such as transparent vinyl chloride may be bonded to a part of the discharge bucket 50C to visually confirm the amount of sheet roll 4. Needless to say, transparent materials may be used for the other part of the discharge bucket 50C.

Thus, according to the third variation, the amount of the sheet roll 4 remaining can be visually confirmed without detaching the discharge bucket 50C and the discharge guide plate 28 from the image forming apparatus 100 and degrading discharge performance of the sheet 10.

Figure 9:
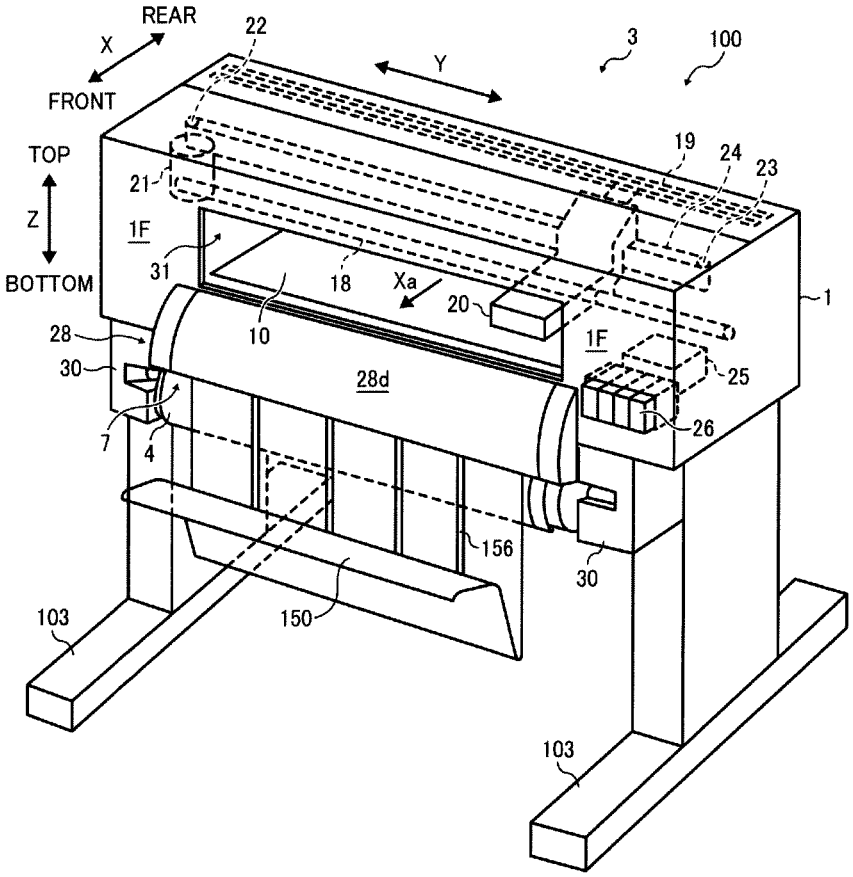
FIG. 9 is a perspective view illustrating an example of a configuration of an image forming apparatus according to a second illustrative embodiment.
Figure 10:
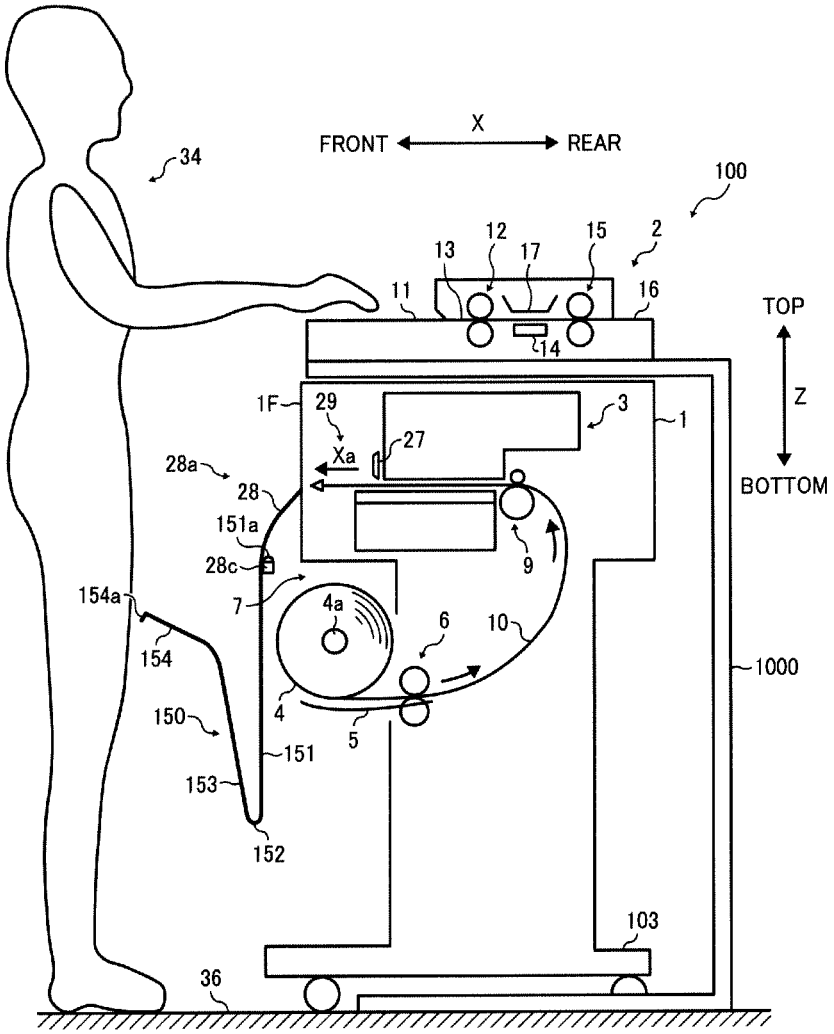
FIG. 10 is a vertical cross-sectional view illustrating the configuration of the image forming apparatus illustrated in FIG. 9.

A description is now given of a second illustrative embodiment of the present invention, with reference to FIGS. 9 and 10. FIG. 9 is a perspective view illustrating an example of a configuration of the image forming apparatus 100 according to the second illustrative embodiment. FIG. 10 is a vertical cross-sectional view illustrating the configuration of the image forming apparatus 100 illustrated in FIG. 9. It is to be noted that the image reading unit 2 and the stand 1000 are not shown in FIG. 9 for ease of illustration.

A configuration and operation of the image forming apparatus 100 according to the second illustrative embodiment are described in detailed below. The description similar to the first illustrative embodiment is omitted. The sheet 10 having the image thereon is discharged from the image forming apparatus 100 and is then guided by the discharge guide plate 28 to be stacked within a stacking unit 150 disposed below the discharge guide plate 28. A square bar-shaped engagement member 28*c* is formed together with the bottom end 28*b* of the discharge guide plate 28. The engagement member 28*c* engages an engaged member 151*a* provided to an upper end of the stacking unit 150. The engaged member 151*a* is substantially U-shaped having a downward-facing opening.

The stacking unit 150 is a discharge tray and formed of a thin resin plate. The engaged member 151*a* engages the engagement member 28*c* of the discharge guide plate 28 so that the stacking unit 150 is disposed with a front end 154*a* protruding in the sheet discharging direction Xa. At this time, the front end 154*a* of the stacking unit 150 is positioned to facilitate operation and maintenance on the image forming apparatus 100 from the front side 1F of the image forming apparatus 100. Although being provided separately from the discharge guide plate 28 in the above-described example, alternatively, the stacking unit 150 may be formed together with the discharge guide plate 28 as a single integrated unit.

A center portion 28*d* of the discharge guide plate 28 excluding both ends of the discharge guide plate 28 in the main scanning direction Y is hingedly openable around a hinge provided to the front surface 1F of the image forming apparatus 100 below the discharge opening 31. The center portion 28*d* is formed separately from the engagement member 28*c*. When the center portion 28*d* is closed, backward swing of the center portion 28*d* in the front and rear directions X is restricted by the engagement member 28*c* which passes throughout both ends of the discharge guide plate 28 in the main scanning direction Y.

The stacking unit 150 is detachably attachable to the main body 1 of the image forming apparatus 100. In order to attach the stacking unit 150 to the main body 1 of the image forming apparatus 100, first, the center portion 28*d* of the discharge guide plate 28 is opened, and then the engaged members 151*a* of the stacking unit 150 are engaged with the engagement member 28*c*. As a result, the U-shaped engaged members 151*a* of the stacking unit 150 are engaged with the square bar-shaped engagement member 28*c* with a predetermined amount of frictional force. The above-described steps of operation are reversed to detach the stacking unit 150 from the main body 1 of the image forming apparatus 100. Thus, the above-described uncomplicated configuration according to the second illustrative embodiment can facilitate attachment and detachment of the stacking unit 150 to and from the image forming apparatus 100.

The stacking unit 150 is easily attached to and detached from the main body 1 of the image forming apparatus 100 upon replacement of the stacking unit 150 or the sheet roll 4 with another type of the stacking unit or the sheet roll.

Figure 11:
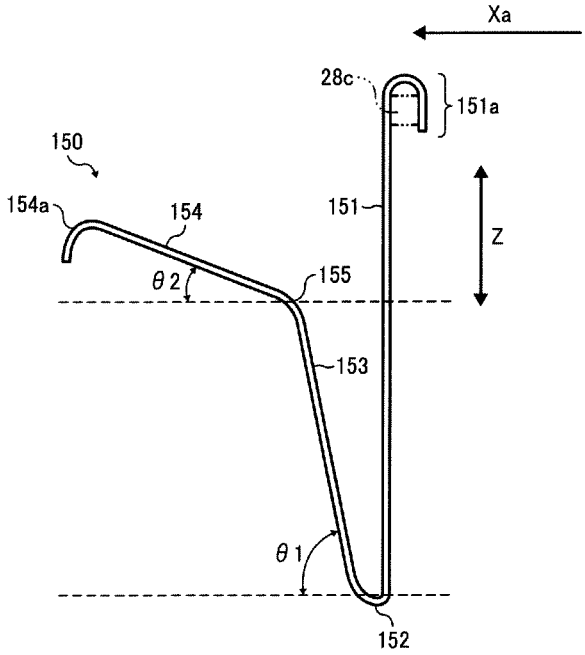
FIG. 11 is a schematic view illustrating an example of a configuration of a stacking unit according to the second illustrative embodiment.

A detailed configuration of the stacking unit 150 is described below with reference to FIG. 11. FIG. 11 is a schematic view illustrating an example of a configuration of the stacking unit 150 according to the second illustrative embodiment.

A restriction member 152 that restricts a position of the leading edge of the sheet 10 discharged from the discharge opening 31 formed in the front side 1F of the main body 1 in the sheet discharging direction Xa is provided to a bottom end of the stacking unit 150. The stacking unit 150 further includes a guide member 151 that guides the leading edge of the sheet 10 to the restriction member 152, a first sloped portion 153 continuous with the restriction member 152 to stack a top part of the sheet 10, and a second sloped portion 154 continuous with an upper end of the first sloped portion 153 to stack a bottom part of the sheet 10 such that the trailing edge of the sheet 10 hangs from the front end 154*a* of the stacking unit 150, which is the extreme downstream side of the stacking unit 150 in the sheet discharging direction Xa. The first sloped portion 153 is extended upward from the restriction member 152 at a slant of θ1 from the horizontal, such that a distance between the guide member 151 and the first sloped portion 153 is increased in the sheet discharging direction Xa as the first sloped portion 153 is extended upward. The second sloped portion 154 is slanted at an angle of θ2 to the horizontal, which is gentler than the first sloped portion 153. The first and second sloped portions 153 and 154 are continuous with each other via a coupling member 155 which is bent and protruding upward.

The guide member 151 is extended in the vertical direction Z. It is to be noted that the angle θ1 is formed between the first sloped portion 153 and a broken horizontal line perpendicular to the vertical direction Z in FIG. 11, and the angle θ2 is formed between the second sloped portion 154 and a broken horizontal line perpendicular to the vertical direction Z in FIG. 11.

The stacking unit 150 is extended across the main scanning direction Y and formed of a resin plate as a single integrated unit. Multiple ribs 156 each guiding the leading edge of the sheet 10 are formed in the stacking unit 150. The multiple ribs 156 are provided not only for guiding the leading edge of the sheet 10 but also for reinforcing the stacking unit 150. Although the stacking unit 150 is formed of a resin material as a single integrated unit in the above-described example, alternatively, it may be formed of a sheet member such as cloth or film which is supported by multiple support shafts to have the configuration illustrated in FIG. 11.

Figure 12A:
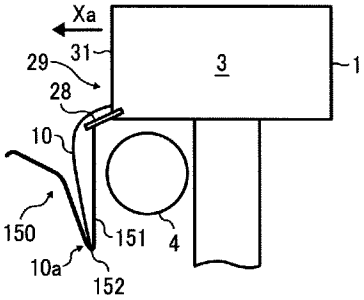
FIGS. 12A to 12C are schematic views illustrating transitional states of a sheet discharged to the stacking unit according to the second illustrative embodiment.
Figure 12B:
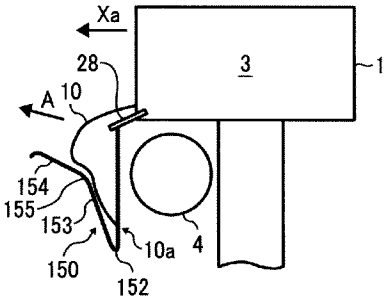
Figure 12C:
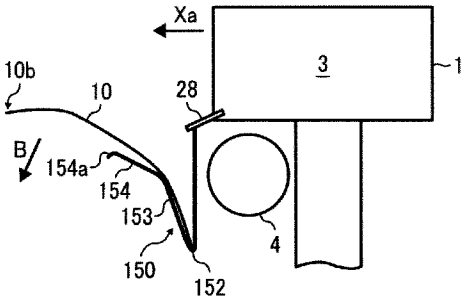

A description is now given of discharge of the sheet 10 to the stacking unit 150 according to the second illustrative embodiment with reference to FIGS. 12A to 12C. FIGS. 12A to 12C are schematic views illustrating transitional states of the sheet 10 discharged to the stacking unit 150, respectively.

A leading edge 10*a* of the sheet 10 discharged from the discharge opening 31 of the sheet discharger 29 is guided by the discharge guide plate 28 and the guide member 151 of the stacking unit 150 to reach the restriction member 152 as illustrated in FIG. 12A. When the leading edge 10*a* of the sheet 10 contacts the restriction member 152, the sheet 10 is bent toward the first sloped portion 153 due to a force of the sheet 10 discharged from the image forming apparatus 100 so that the top part of the image forming surface of the sheet 10 having the image thereon contacts the first sloped portion 153. As being further discharged, the sheet 10 is bent at the coupling member 155 between the first and second sloped portions 153 and 154 toward the downstream side in the sheet discharging direction Xa as indicated by arrow A in FIG. 12B. In that state, the sheet 10 is cut at a trailing edge 10*b* and discharged so that the trailing edge 10*b* of the sheet 10 is bent toward the downstream side in the sheet discharging direction Xa with its stiffness. As a result, the bottom part of the image forming surface of the sheet 10 is stacked on the second sloped portion 154 with the trailing edge 10*b* hanging from the front end 154*a* downward as indicated by arrow B in FIG. 12C. Thus, the sheet 10 is stacked on the stacking unit 150.

A description is now given of a relation between the first and second sloped portions 153 and 154 of the stacking unit 150 and the size of the sheet 10 cut by the cutter 27.

The stacking unit 150 according to the second illustrative embodiment can stack the sheet 10 of two different sizes of Lx and 2Lx together at the same time. Here, each of Lx and 2Lx is a lateral length of the sheet 10 cut by the cutter 27 in the sheet discharging direction Xa, and a longitudinal length of the sheet 10 is the maximum available width of the sheet roll 4 that can be accommodated within the sheet roll storage in the main body 1 of the image forming apparatus 100 in the width direction Y. The sheet roll storage is composed of the opening 7 and spool bearings 30. The sheet 10 having the lateral width of Lx after being cut by the cutter 27 is hereinafter also referred to as a small-sized sheet 10, and the sheet 10 having the lateral width of 2Lx after being cut by the cutter 27 is hereinafter also referred to as a large-sized sheet 10.

The stacking unit 150 has the above-described configuration in order to meet demand described below. An image forming apparatus using a large-sized sheet roll generally forms an image on a sheet of the single size that can be fed from the sheet roll having the maximum width settable in the image forming apparatus. For example, in an image forming apparatus in which a sheet roll having a width of 594 mm is set, only a sheet of the single size having an available output range of 841 mm in a longitudinal width and 420 mm in a lateral width is generally used. Therefore, it does not cause any inconvenience when the sheet 10 of the two different sizes, one of which is twice as long as the other in the sheet discharging direction Xa, can be stacked together on the stacking unit 150 in proper order.

Figure 13:
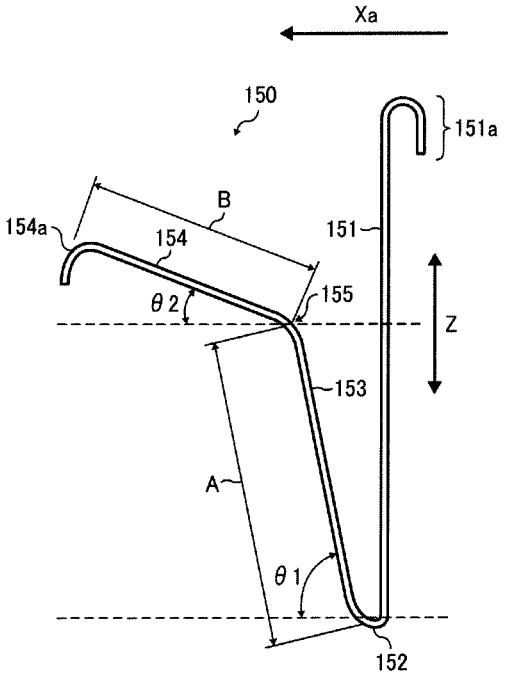
FIG. 13 is a schematic view illustrating an example of a configuration of first and second sloped portions of the stacking unit according the second illustrative embodiment.

FIG. 13 is a schematic view illustrating an example of a configuration of the first and second sloped portions 153 and 154 of the stacking unit 150 according the second illustrative embodiment. As shown in FIG. 13, a length A of the first sloped portion 153 is shorter than the length Lx of the small-sized sheet 10. It is to be noted that, in FIG. 13, a length B of the second sloped portion 154 is a distance from the coupling member 155 to the front end 154*a* of the stacking unit 150 in the sheet discharging direction Xa.

Figure 14A:
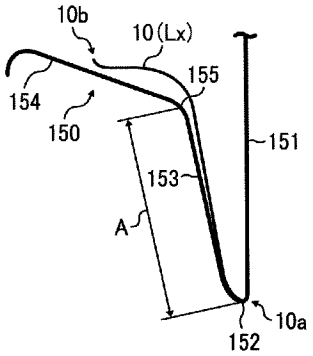
FIG. 14A is a schematic view illustrating a state of a small-sized sheet stacked on the stacking unit.

Because the small-sized sheet 10 discharged to the stacking unit 150 is curled up, it is necessary to bend the sheet 10 against the curling of the sheet 10 using the coupling member 155 formed between the first and second sloped portions 153 and 154 as illustrated in FIG. 14A, thereby preventing the sheet 10 from being rolled up. If the length A of the first sloped portion 153 is longer than the length Lx of the small-sized sheet 10, the small-sized sheet 10 cannot be bent against the curling thereof at the coupling member 155.

Figure 14B:
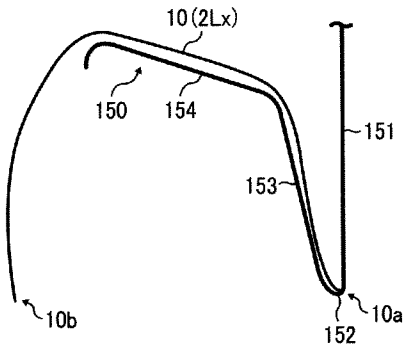
FIG. 14B is a schematic view illustrating a state of a large-sized sheet stacked on the stacking unit.
Figure 14C:
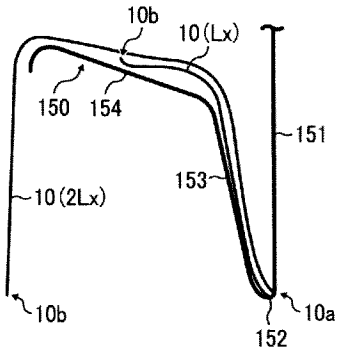
FIG. 14C is a schematic view illustrating a state in which both the small and large-sized sheets are stacked together on the stacking unit.

In a case in which both the small and large-sized sheets 10 are stacked together on the stacking unit 150 as illustrated in FIG. 14C, when the trailing edge 10*b* of the small-sized sheet 10, which has already been stacked on the stacking unit 150, is bent toward the second sloped portion 154, the trailing edge 10*b* of the large-sized sheet 10 discharged to the stacking unit 150 later does not hit against the trailing edge 10*b* of the small-sized sheet 10, thereby reliably stacking the large-sized sheet 10 on the stacking unit 150. Thus, the first sloped portion 153 having the length A shorter than the length Lx of the small-sized sheet 10 can achieve proper stacking of both the small and large-sized sheets 10 together on the stacking unit 150. The above-described effect can also be achieved when the multiple small-sized sheets 10 are continuously discharged and stacked on the stacking unit 150.

In order to properly stack the large-sized sheet 10 having the length of 2Lx on the stacking unit 150 as illustrated in FIG. 14B, it is necessary to secure the balance between a length of a part of the sheet 10 contacting the stacking unit 150 and a length of the rest of the sheet 10 hanging outwardly from the stacking unit 150, thereby preventing the large-sized sheet 10 from dropping off from the second sloped portion 154 of the stacking unit 150.

FIG. 15 is a table showing a relation between a total length (A+B) of the first and second sloped portions 153 and 154 of the stacking unit 150 and evaluation results of stacking performance of the stacking unit 150 that stacks the large-sized sheet 10.

The evaluation test was performed under the following conditions. The sheet roll 4 has a weight of 70 g/m$^2$, and the maximum available width of the sheet roll 4 which can be accommodated within the image forming apparatus 100 according to the second illustrative embodiment is 841 mm, that is, AO size. The sheet 10 is cut from the sheet roll 4 to the length Lx or 2Lx of 594 mm or 1,188 mm. The first sloped portion 153 of the stacking unit 150 is disposed at the angle θ1 of 65°±3°, and the second sloped portion 154 of the stacking unit 150 is disposed at the angle θ2 of 35°±3°.

It was confirmed that the large-sized sheet 10 can be properly stacked on the stacking unit 150 when the total length (A+B) of the first and second sloped portions 153 and 154 is longer than a length of 4Lx/5.

In the stacking unit 150 according to the second illustrative embodiment, the second sloped portion 154 needs to be sloped upward from the first sloped portion 153. If the second sloped portion 154 is sloped downward from the first sloped portion 153, the stacking performance of the stacking unit 150 is reduced. Consequently, even when the total length (A+B) of the first and second sloped portions 153 and 154 are set as described above, the large-sized sheet 10 is dropped off from the second sloped portion 154 of the stacking unit 150.

In addition, in order to bend the small-sized sheet 10 against the curling of the sheet 10 at the coupling member 155 between the first and second sloped portions 153 and 154 as illustrated in FIG. 14A, the second sloped portion 154, which is slanted at the angle θ2, needs to be gentle compared to the first sloped portion 153, which is slanted at the angle θ1. If the second sloped portion 154 is steeper than the first sloped portion 153, the small-sized sheet 10 discharged to the stacking unit 150 is rolled up between the guide member 151 and the first sloped portion 153 due to the curling of the sheet 10. In view of the above, it is desirable that the angle θ1 be set within a range from 45° to less than 90°, and the angle θ2 be set within a range from 0° to less than 45°.

A description is now given of a distance between the guide member 151 and the first sloped portion 153 at the restriction member 152 in the sheet discharging direction Xa with reference to FIGS. 16A and 16B. FIG. 16A is a schematic view illustrating a state of the leading edge 10*a* of the sheet 10 guided by a restriction member 552 of a stacking unit 500 according to a comparative example. FIG. 16B is a schematic view illustrating a state of the leading edge 10*a* of the sheet 10 guided by the restriction member 152 of the stacking unit 150 according to the second illustrative embodiment. In FIG. 16A, reference numeral 551 denotes a guide member, reference numeral 553 denotes a first sloped portion, reference numeral 554 denotes a second sloped portion, and reference numeral 555 denotes a coupling member.

In the comparative example illustrated in FIG. 16A, a distance E between the guide member 551 and the first sloped portion 553 in the sheet discharging direction Xa is larger than a minimum diameter of the sheet roll 4 that can be accommodated within the image forming apparatus 100. In such a case, the leading edge 10*a* of the sheet 10 that reaches the restriction member 552 tends to roll up due to the curling of the sheet 10. Consequently, the sheet 10 cannot be bent against the curing at the coupling member 555.

By contract, in the stacking unit 150 according to the second illustrative embodiment illustrated in FIG. 16B, a distance between the guide member 151 and the first sloped portion 153 in the sheet discharging direction Xa is smaller than the minimum diameter of the sheet roll 4 settable in the image forming apparatus 100. In other words, the distance between the guide member 151 and the first sloped portion 153 is smaller than a diameter of the curling of the sheet 10. Accordingly, the leading edge 10*a* of the sheet 10 discharged to the stacking unit 150 is guided by the guide member 151 and the first sloped portion 153 and is restricted by the restriction member 152. Thus, the sheet 10 can be bent against the curing thereof at the coupling member 155 by its own stiffness. It is to be noted that the minimum diameter of the sheet roll 4 is an outer diameter of the core of the sheet roll 4. The distance between the guide member 151 and the first sloped portion 153 in the sheet discharging direction Xa is not necessarily smaller than the minimum diameter of the sheet roll 4 throughout the first sloped portion 153.

According to the second illustrative embodiment, the stacking unit 150 can achieve a user-friendly configuration and prevent the sheet 10 discharged to the stacking unit 150 from dropping off from the stacking unit 150, thereby reliably stacking the sheet 10. In addition, both the small and large-sized sheets 10 each having the difference size can be stacked together in proper order on the stacking unit 150. When the total length (A+B) of the first and second sloped portions 153 and 154 of the stacking unit 150 is longer than the length of 4Lx/5, the large-sized sheet 10 can be properly stacked on the stacking unit 150. Further, in the second illustrative embodiment, the distance between the guide member 151 and the first sloped portion 153 in the sheet discharging direction Xa is smaller than the minimum diameter of the sheet roll 4. Accordingly, the leading edge 10*a* of the sheet 10 discharged to the stacking unit 150 is guided by the guide member 151 and the first sloped portion 153 and is restricted by the restriction member 152. Thus, the sheet 10 can be bent against the curing thereof at the coupling member 155 by its own stiffness and be properly stacked on the stacking unit 150.

Figure 17A:
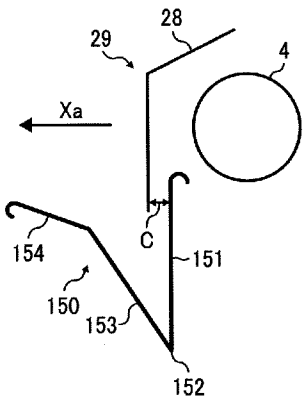
FIG. 17A is a schematic view illustrating relative positions of a sheet discharger and a guide member of a stacking unit according to a first variation of the second illustrative embodiment.
Figure 17B:
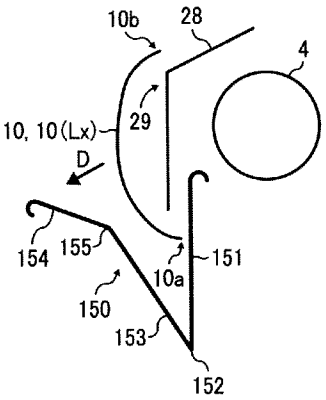
FIG. 17B is a schematic view illustrating a state of a small-sized sheet discharged to the stacking unit according to the first variation of the second illustrative embodiment.
Figure 17C:
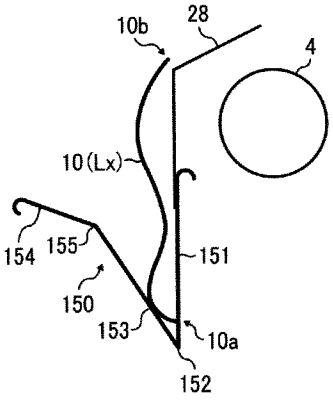
FIG. 17C is a schematic view illustrating a state of a small-sized sheet discharged to the stacking unit according to the second illustrative embodiment.

A description is now given of a first variation of the second illustrative embodiment with reference to FIGS. 17A to 17C. FIG. 17A is a schematic view illustrating relative positions of the discharge guide plate 28 and the guide member 151 of the stacking unit 150 according to the first variation. FIG. 17B is a schematic view illustrating a state of the small-sized sheet 10 discharged to the stacking unit 150 according to the first variation. FIG. 17C is a schematic view illustrating a state of the small-sized sheet 10 discharged to the stacking unit 150 according to the second illustrative embodiment. The bottom end 28*b* of the discharge guide plate 28 is omitted in FIGS. 17A to 17C for ease of illustration.

The difference between the second illustrative embodiment and the first variation is a position of the stacking unit 150 relative to the discharge guide plate 28. The rest of the configuration according to the first variation is the same as that of the second illustrative embodiment.

As illustrated in FIGS. 17A and 17B, the guide member 151 of the stacking unit 150 according to the first variation is disposed upstream from the discharge guide plate 28 in the sheet discharging direction Xa. Specifically, the guide member 151 is offset from the discharge guide plate 28 by a distance C toward the main body 1 of the image forming apparatus 100.

The sheet 10 discharged from the main body 1 of the image forming apparatus 100 is guided from the discharge guide plate 28 to the guide member 151, and the leading edge 10*a* of the sheet 10 enters the restriction member 152 while contacting the discharge guide member 151 due to the curling of the sheet 10. At that time, the small-sized sheet 10 discharged to the stacking unit 150 may be cut by the cutter 27 at the trailing edge 10*b* thereof before the leading edge 10*a* reaches the restriction member 152. In a case in which the guide member 151 is disposed closer to the main body 1 of the image forming apparatus 100 than the discharge guide plate 28 as illustrated in FIGS. 17A and 17B, the leading edge 10*a* of the small-sized sheet 10 contacts the guide member 151 or is positioned closer to the guide member 151 than the discharge guide plate 28 in the sheet discharging direction Xa due to the curling of the sheet 10 while being discharged. Accordingly, the trailing edge 10*b* of the small-sized sheet 10 cut by the cutter 27 is rotated around the leading edge 10*a* as indicated by arrow D in FIG. 17B. Thus, the small-sized sheet 10 can be properly stacked on the stacking unit 150. Therefore, even in the case of discharging the small-sized sheet 10 which cannot be discharged to the stacking unit 150 in the steps illustrated in FIGS. 12A to 12C, the small-sized sheet 10 can be properly guided to the first and second sloped portions 153 and 154 of the stacking unit 150, thereby being securely stacked on the stacking unit 150.

By contrast, in the stacking unit 150 according to the second illustrative embodiment, the guide member 151 is positioned substantially beneath the discharge guide plate 28 in the sheet discharging direction Xa as illustrated in FIG. 17C. Consequently, in a case in which the small-sized sheet 10 discharged to the stacking unit 150 has less stiffness, the small-sized sheet 10 directly falls down to the stacking unit 150 and is bent without being bent against the curling of the sheet 10 at the coupling member 155. As a result, the small-sized sheet 10 cannot be properly stacked on the stacking unit 150.

However, in the configuration according to the first variation of the second illustrative embodiment, even in the case in which the sheet 10 is cut by the cutter 27 at the trailing edge 10*b* thereof before the leading edge 10*a* reaches the restriction member 152, the sheet 10 can be guided along the first and second sloped portions 153 and 154 of the stacking unit 150.

Figure 18:
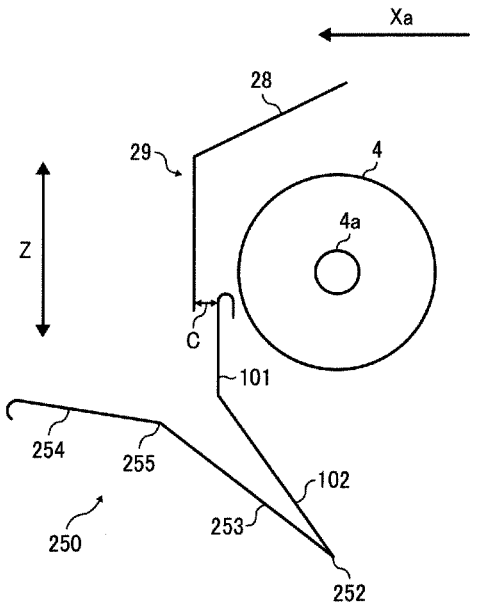
FIG. 18 is a schematic view illustrating an example of a configuration of a stacking unit according to a second variation of the second illustrative embodiment.

A description is now given of a second variation of the second illustrative embodiment with reference to FIG. 18.

In place of the stacking unit 150 of the first variation, a stacking unit 250 is used in the second variation. In addition, in place of the guide member 151 of the stacking unit 150 according to the first variation, the stacking unit 250 of the second variation includes an opposing portion 101 provided opposite the sheet roll 4 and a bending portion 102 provided continuously with the opposing portion 101 below the sheet roll 4. The rest of the configuration according to the second variation is the same as that of the first variation. It is to be noted that in FIG. 18, reference numeral 252 denotes a restriction member, reference numeral 253 denotes a first sloped portion, reference numeral 254 denotes a second sloped portion, and reference numeral 255 denotes a coupling member.

Because the bending portion 102 is disposed below the sheet roll 4, an amount of protrusion of the second sloped portion 254 beyond the front side 1F of the image forming apparatus 100 can be reduced. Accordingly, the user 34 can easily access the interior of the main body 1 of the image forming apparatus 100 and the image reading unit 2 disposed above the main body 1.

It is to be noted that illustrative embodiments of the present invention are not limited to those described above, and various modifications and improvements are possible without departing from the scope of the present invention. It is therefore to be understood that, within the scope of the associated claims, illustrative embodiments may be practiced otherwise than as specifically described herein. For example, elements and/or features of different illustrative embodiments may be combined with each other and/or substituted for each other within the scope of the illustrative embodiments.

The image forming unit 3 is not limited to a serial-type inkjet recording device. Alternatively, a line-type inkjet recording device, an image forming device employing an electrophotographic method, or a device having two or more of the functions of the serial-type inkjet recording device, the line-type inkjet recording device, and the image forming device employing the electrophotographic method may be used as the image forming unit 3.

In addition, the image forming apparatus 100 may include a control panel serving as an operating unit at the top in the front side thereof in addition to the image reading unit 2. Further, the image reading unit 2 may not be provided to the image forming apparatus 100. In such a case, for example, the image forming apparatus 100 forms images based on data externally input from a computer or the like or data recorded in storage media such as compact disks.

The image forming apparatus 100 may employ either the spool system using the spool shaft or a flange system using flanges to support the sheet roll 4 such that the sheet 10 is fed from the sheet roll 4.

What is claimed is:

1. An image forming apparatus comprising:

an image forming unit disposed in a main body of the image forming apparatus, to form an image on a sheet;

a sheet feeder including a pair of supporter members each including integrally formed therein:

a rod supporter; and a sheet roll supporter disposed below the main body of the image forming apparatus to support a sheet roll formed of a continuous sheet and accommodated in an open region below the image forming unit disposed in the main body of the image forming apparatus, wherein the sheet feeder feeds the continuous sheet from the sheet roll supported by the sheet roll supporter to the image forming unit disposed in the main body of the image forming apparatus, to form an image thereon;

a cutter to cut off a cut sheet of a predetermined length from the continuous sheet fed from the sheet roll;

a sheet discharger disposed downstream from the image forming unit in a direction of conveyance of the sheet to discharge the cut sheet having the image formed thereon in a sheet discharging direction through a discharge opening of the main body of the image forming apparatus;

a guide unit to guide the sheet discharged from the sheet discharger to the front of the main body of the image forming apparatus; and a stacking unit on which the sheet passing the guide unit is stacked, wherein upper and front parts of the sheet roll are covered with the guide unit and the stacking unit across a width direction of the sheet perpendicular to the sheet discharging direction, wherein the guide unit includes a discharge guide plate disposed downstream from the discharge opening of the main body and outside a front surface of the main body, the discharge guide plate including a guiding surface on which the sheet is guided downwards projecting gradually away from the front surface of the main body, wherein the discharge guide plate covers an upper part of an opening to the open region in which the sheet roll is accommodated, and the discharge guide plate is swingable away from the open region to uncover the upper part of the opening to the open region, wherein the stacking unit includes a sheet discharge bucket to collect sheets that have passed through the discharge guide plate, a discharge rod to support an upper end of the sheet discharge bucket, the discharge rod being supported by the rod supporter of each of the pair of supporter members, wherein the rod supporter that supports the discharge rod is disposed at a height that is substantially the same as that of the sheet roll supporter that supports the sheet roll, and the upper end of the sheet discharge bucket supported by the discharge rod is continuous with the discharge guide plate.

2. The image forming apparatus according to claim 1, wherein the rod supporter is combined with the sheet roll supporter as a single integrated unit.

3. The image forming apparatus according to claim 1, wherein the discharge rod is detachably supported by the rod supporter.

4. The image forming apparatus according to claim 1, wherein:

the sheet discharge bucket is formed of a flexible material; and one end of the sheet discharge bucket is fixed to the discharge rod to hang from a position overlapping a bottom end of the discharge guide plate so that the discharge guide plate and the sheet discharge bucket, in combination, cover the upper and front parts of the sheet roll across the width direction of the sheet.

5. The image forming apparatus according to claim 1, wherein:

the guide unit has a support shaft; and the discharge guide plate is swingable upward around the support shaft.

6. The image forming apparatus according to claim 1, wherein the stacking unit is formed separately from the image forming apparatus and is detachably attachable to the image forming apparatus.

7. The image forming apparatus according to claim 1, wherein the stacking unit comprises:

a restriction member provided to a bottom end of the stacking unit to restrict a position of a leading edge of the sheet discharged to the stacking unit;

a guide member continuous with the restriction member to guide the leading edge of the sheet to the restriction member;

a first sloped portion on which a top part of an image forming surface of the sheet discharged to the stacking unit is placed, the first sloped portion being continuous with the restriction member and slanted upward at an angle to the horizontal $\theta 1$ such that a distance from the guide member in the sheet discharging direction is increased from the restriction member upward; and a second sloped portion on which a bottom part of the image forming surface of the sheet discharged to the stacking unit is placed, the second sloped portion being continuous with an upper end of the first sloped portion and slanted at an angle to the horizontal $\theta 2$ that is smaller than $\theta 1$.

8. The image forming apparatus according to claim 7, wherein the distance between the guide member and the first sloped portion at the restriction member is smaller than a minimum outer diameter of a sheet roll installable in the image forming apparatus.

9. The image forming apparatus according to claim 7, wherein:

the stacking unit stacks sheets of multiple sizes cut by the cutter; and the first sloped portion has a length shorter than a minimum length of a sheet in the sheet discharging direction among the sheets of multiple sizes.

10. The image forming apparatus according to claim 7, wherein:

the stacking unit stacks sheets of multiple sizes cut by the cutter; and a total length of the first and second sloped portions is longer than 4Lx/5, where 2Lx is a maximum length of a sheet in the sheet discharging direction among the sheets of multiple sizes.

11. The image forming apparatus according to claim 8, wherein the guide member comprises:

an opposing portion provided opposite the sheet roll supporter; and a bending portion provided below the opposing portion such that the restriction member is positioned below the sheet roll supporter.

12. An image forming apparatus comprising:

a sheet roll supporter disposed below a main body of the image forming apparatus to support a sheet roll formed of a single continuous sheet such that the sheet is fed from the sheet roll;

an image forming unit to form an image on the sheet fed from the sheet roll supported by the sheet roll supporter;

a sheet discharger disposed downstream from the image forming unit in a direction of conveyance of the sheet to discharge the sheet having the image formed thereon in a sheet discharging direction;

a guide unit to amide the sheet discharged from the sheet discharger to the front of the main body of the image forming apparatus; and a stacking unit on which the sheet passing the guide unit is stacked, wherein upper and front parts of the sheet roll are covered with the guide unit and the stacking unit across a width direction of the sheet perpendicular to the sheet discharging direction, and wherein the stacking unit comprises:

a main body formed of a flexible material; and a transparent part, provided in front of the sheet roll within a range in the main body of the stacking unit through which a sheet of a minimum size usable in the image forming apparatus passes.

* * * * *